United States Patent [19]

Herring

[11] Patent Number: 4,827,748

[45] Date of Patent: May 9, 1989

[54] COLD FORMING TOOL

[75] Inventor: Donald G. Herring, Houston, Tex.

[73] Assignee: Cameron Iron Works USA, Inc., Houston, Tex.

[21] Appl. No.: 217,158

[22] Filed: Jul. 11, 1988

[51] Int. Cl.[4] ..... B23P 17/00

[52] U.S. Cl. ..... 72/62; 72/58; 29/421.1

[58] Field of Search ..... 72/56, 58, 62, 63; 29/421.1, 523, 727; 425/DIG. 19

[56] References Cited

U.S. PATENT DOCUMENTS

| | | | |
|---|---|---|---|
| 2,134,311 | 10/1938 | Minor et al. | 166/14 |
| 2,997,093 | 8/1961 | Harris | 72/63 |
| 3,191,677 | 6/1965 | Kinley | 166/14 |
| 3,434,194 | 3/1969 | Whittaker et al. | 29/421 |
| 3,712,376 | 1/1973 | Owen et al. | 166/277 |
| 4,339,935 | 7/1982 | Pettersson | 72/63 |
| 4,382,373 | 5/1983 | Pettersson | 72/63 |
| 4,388,752 | 6/1983 | Vinciguerra et al. | 29/421 |
| 4,608,739 | 9/1986 | Miller | 72/58 |
| 4,648,626 | 3/1987 | Vinciguerra et al. | 285/15 |
| 4,662,663 | 5/1987 | Schmitz | 285/382 |
| 4,724,693 | 2/1988 | Tedder | 29/421.1 |

*Primary Examiner*—David Jones
*Attorney, Agent, or Firm*—Vinson & Elkins

[57] ABSTRACT

A forming tool including a mandrel having nuts threaded on its exterior at both ends with an outer cylindrical surface between the nuts, a forming assembly positioned around said mandrel between said nuts, the forming assembly including a pair of end rings having inner lips extending axially along said outer cylindrical surface and an overhang with a re-entrant recess between the joining of the lip with the remainder of the end ring, a resilient sleeve having its ends bonded within said re-entrant recesses of said end rings and extending in surrounding relationship to said cylindrical mandrel surface, means surrounding each end of said sleeve adjacent said end rings to prevent extrusion of the material of said sleeve, seals for sealing between the exterior of said mandrel and the interior of said end ring lips, and means for supplying pressure to the interior of said sleeve to move it radially outward with sufficient force to form a member surrounding the tool outward.

9 Claims, 4 Drawing Sheets

COLD FORMING TOOL

BACKGROUND

The present invention relates to a tool which is suitable for being positioned within a first tubular member and capable of expanding that tubular member into tight sealing engagement with the interior of a second tubular member surrounding the first tubular member. This tool is particularly useful in the forging of connections between tubular members or of a tubular member into a ring such as a hanger within a well bore.

U.S. Pat. No. 4,662,663 discloses pressure forming of a tubular member in an underwater location to provide a connection between two tubular members, such as in repair of an undersea pipeline. This tool utilizes a metal mandrel which is surrounded by an elastomeric sleeve which engages the tubular member to be formed and pressure is delivered to the interior of the elastomeric sleeve which is sufficient to deform the tubular member outwardly into tight sealing engagement with the annular member it is to engage. U.S. Pat. No. 4,648,626 discloses a similar structure and U.S. Pat. No. 4,388,752 discloses another type of forming tool which subjects the elastomeric sleeve to axial loading to cause it to expand the tubular member radially outward.

U.S. Pat. No. 2,134,311 discloses the mechanical forming of a casing string into the interior of a casing head through the use of rollers which are forced outwardly by the action of a conical surface. Other mechanical means are disclosed in U.S. Pat. Nos. 3,191,677 and 3,712,376.

Explosives have been used within tubular members to cause them to be deformed radially outward as disclosed in U.S. Pat. No. 3,434,194.

A similar tool is disclosed in applications for U.S. Pat. Ser. No. 07/106,803 filed Oct. 13, 1987 and Ser. No. 07/114,422, filed Oct. 28, 1988. These tools are similar to the present invention but do not provide the structure which results in the advantages provided by the present invention as hereinafter stated.

SUMMARY

The improved cold forging tool of the present invention includes a mandrel having upper and lower rings extending radially outward to provide an upper downwardly facing shoulder and a lower upwardly facing shoulder, a sleeve of resilient material surrounding said mandrel between said rings, a passage through said mandrel communicating with the exterior of the mandrel and within said sleeve for urging said sleeve radially outward, an end ring positioned in engagement with said upper shoulder and an end ring positioned in engagement with said lower shoulder, said end rings having an inner lip extending toward the opposite end ring and a recess for receiving the end of said sleeve, said sleeve being bonded into said recesses in said end rings, a pressure responsive seal positioned within said end ring lips for sealing between said lip and said mandrel and facing toward the opposite seal so that pressure delivered to the interior of said sleeve acts upon said seals, and a pair of segmented anti-extrusion rings positioned adjacent each of said end rings in surrounding and supporting relationship to said sleeve, the recesses in said end rings into which said sleeve ends are bonded being located so that the bonding is only exposed to compressive loading and the lips of said end rings being exposed to forming pressures within said sleeve to urge said lips into tighter engagement with said seals.

An object of the present invention is to provide an improved tubular forming tool which can be used within a well and in which the sealing of the forming pressures to which the resilient sleeve is exposed is pressure responsive.

Another object is to provide an improved tubular forming tool in which the ends of the resilient forming sleeve are bonded and the bonding is only exposed to compressive loading.

A further object is to provide an improved tubular forming tool which can be used to form high strength materials radially outward and without damage to the tool or resilient sleeve by the extremely high forces developed in such forming steps.

BRIEF DESCRIPTION OF THE DRAWINGS

These and other objects of the present invention are hereinafter set forth and explained with reference to the drawings wherein:

FIG. 4 is an elevation view, partly in section of the improved tool during forming and additionally showing the packoff tool carried below the forming tool for testing the pressure sealing of the engagement between the formed tubular members.

DESCRIPTION OF THE PREFERRED EMBODIMENT

Figure 1:
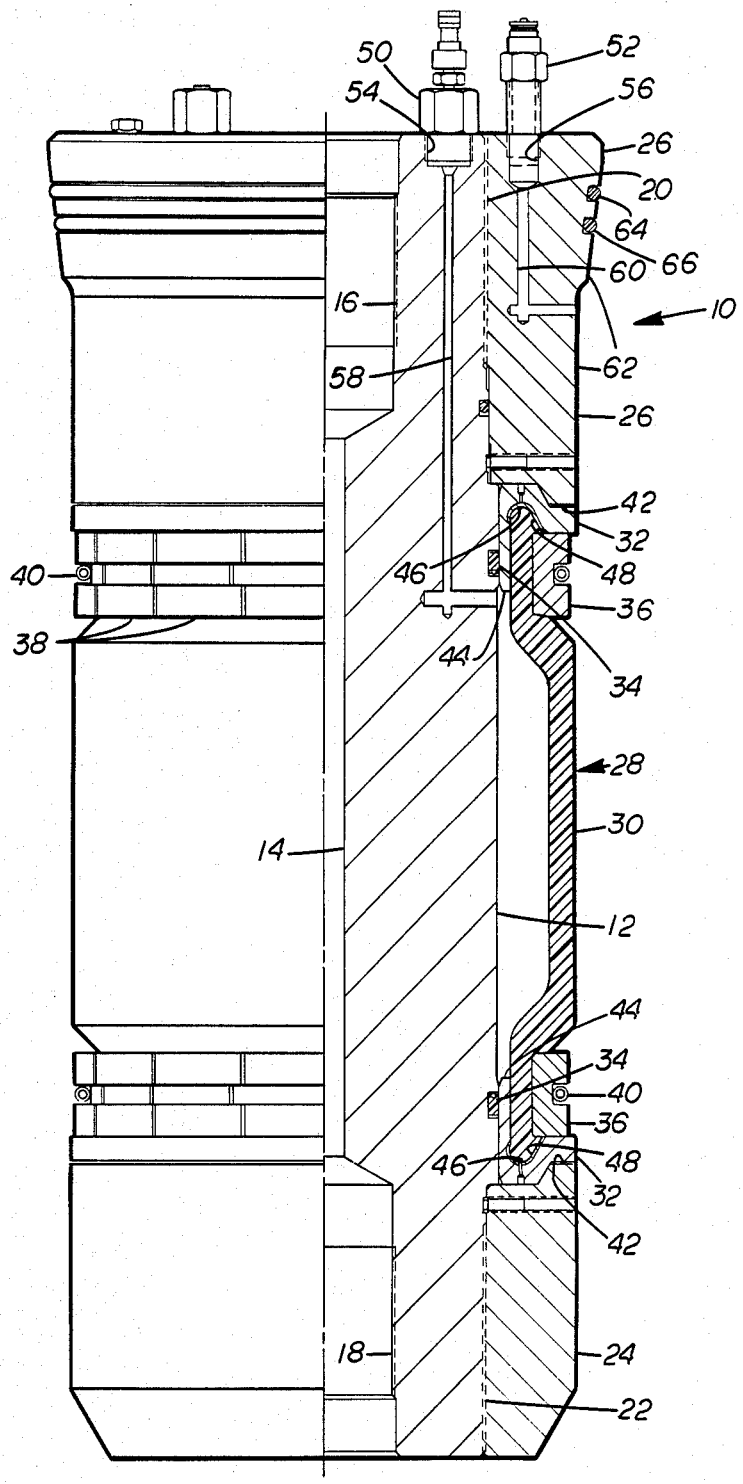

Improved forming tool 10 includes tubular body or mandrel 12 having bore 14 extending therethrough and threads 16 in the upper end of bore 14 and threads 18 in the lower end of bore 14, external threads 20 on the upper portion of said mandrel 12 and lower external threads 22 on the lower portion of said body 12, lower nut 24 threaded onto lower threads 22 and upper nut 26 threaded onto upper threads 20, and resilient forming assembly 28 is positioned around the exterior of mandrel 12 between nuts 24 and 26 as shown in FIG. 1. Thus nuts 24 and 26 provide an upper downwardly facing shoulder and a lower upwardly facing shoulder with the exterior of mandrel 12 between such shoulders being generally cylindrical.

Forming assembly 28 includes resilient sleeve 3 around the cylindrical exterior surface of mandrel 12, end rings 32, seals 34 and anti extrusion rings 36 including anti-extrusion segments 38 held in position against the exterior of sleeve 30 by spring member 40. Nuts 24 and 26 each include outer flange 42 which extend over the inner portions of end rings 32. End rings 32 include inner lips 44 which have their inner surfaces around the exterior surface of mandrel 12 and are sufficiently long so that they are pressure energized inwardly by forming pressures within sleeve 30 to ensure the sealing of seals 34. The outer surfaces of each of lips 44 end in concave surfaces 46 in end rings 32 and concave surfaces 46 lead into tapering surfaces 48 which taper radially outward of mandrel 12 and toward the center of sleeve 30. The ends of sleeve 30 are bonded with a suitable bonding agent, such as the product sold by Hudson Chemical Division of Lord Corp. under the trademark "Chemlok 205", to concave surfaces 46 and tapering surfaces 48 of end rings 32.

Anti-extrusion rings 36 are completely disclosed and their operation explained in the aforementioned copending applications. They function to provide a continuing end support for the moving end portions of sleeve 30 so that such end portions are not exposed to gaps which are sufficient to allow the extrusion of the resilient material of sleeve 30 therethrough. It should also be noted that the end rings which are subjected to forming pressure are subjected to a net radially inward force rather than a net outward force as would be expected of the end rings which anchor the ends of the resilient sleeve 30.

Suitable fittings 50 and 52 are connected into the ends of ports 54 and 56 in mandrel 12 and upper nut 26, respectively. Port 54 communicates through passage 58 to the interior of sleeve 30 between end rings 32. Port 56 communicates through passage 60 to the exterior of nut 26 at a position below the upper outer tapered surface 62 and outer seals 64 and 66 are positioned in grooves in tapered surface 62 surrounding upper nut 26. Liquid under pressure is delivered to the interior of resilient sleeve 30 through fitting 50, port 54 and passage 58. Test pressure is delivered through fitting 52, port 56 and passage 60 to the exterior of upper nut 26 below its seals 64 and 66. Seals 34 are suitable pressure energized seals, such as those provided by Parker Hannifin Corp. under the Trademark "Polypak" and have a seal body with inner and outer legs at one end (the end facing pressure) with a spreader element positioned between the legs and urging them apart for sealing against the inner and outer surfaces against which they are intended to seal. The provision of lips 44 on end rings 32 ensures that the surface surrounding seals 34 and against which they are to seal is urged toward each seal 34 so that such surface is not separated therefrom by the pressure of the forming liquid to which it is exposed.

Figure 2:
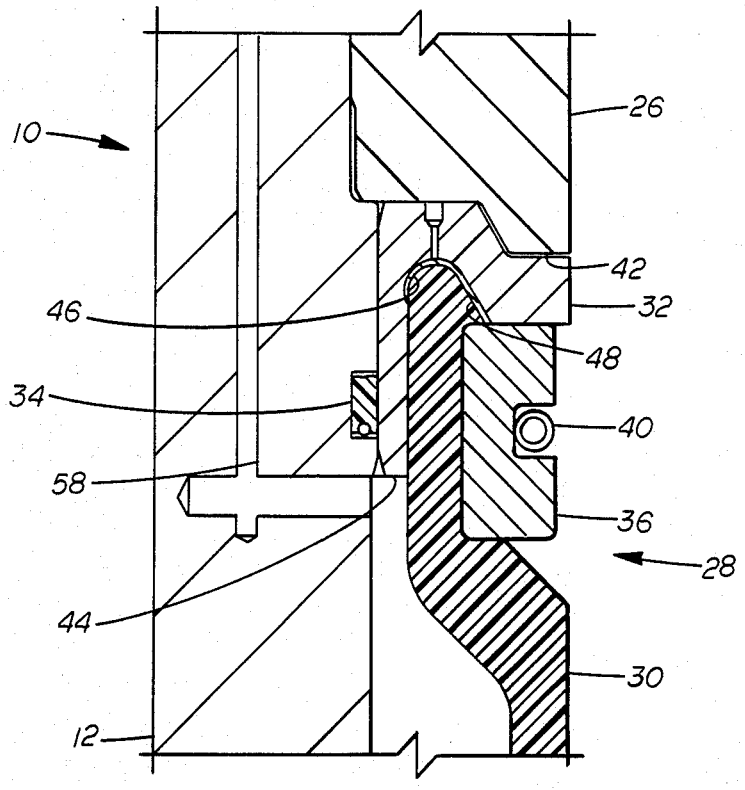
FIG. 2 is a partial detail sectional view to illustrate the structure of the end rings, the bonding of the end of the resilient sleeve thereto and the end ring lip which engages the seal, all shown in relaxed position.
Figure 3:
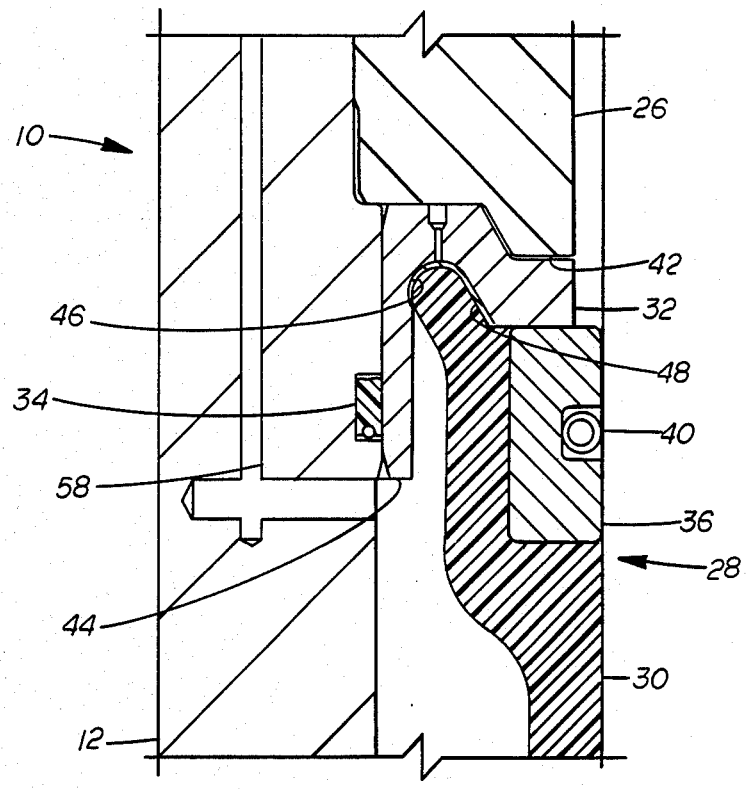
FIG. 3 is an elevation view of the improved tool of the present invention shown partly in section.

The relaxed position of sleeve 30 is shown in FIGS. 1 and 2. The position of sleeve 30 with respect to mandrel 12 and end rings 32 following the application of forming pressure is illustrated in FIG. 3. A careful consideration of FIG. 3 shows that the bonding of the ends of sleeve 30 within the concave and the tapered surfaces 46 and 48 is not exposed to any forces other than compression which tends to urge the ends of sleeve 30 to remain in their bonded positions. The forces on lip 44 which urge it inward to maintain its engagement with seal 34 can also be seen from FIG. 3.

Figure 4:
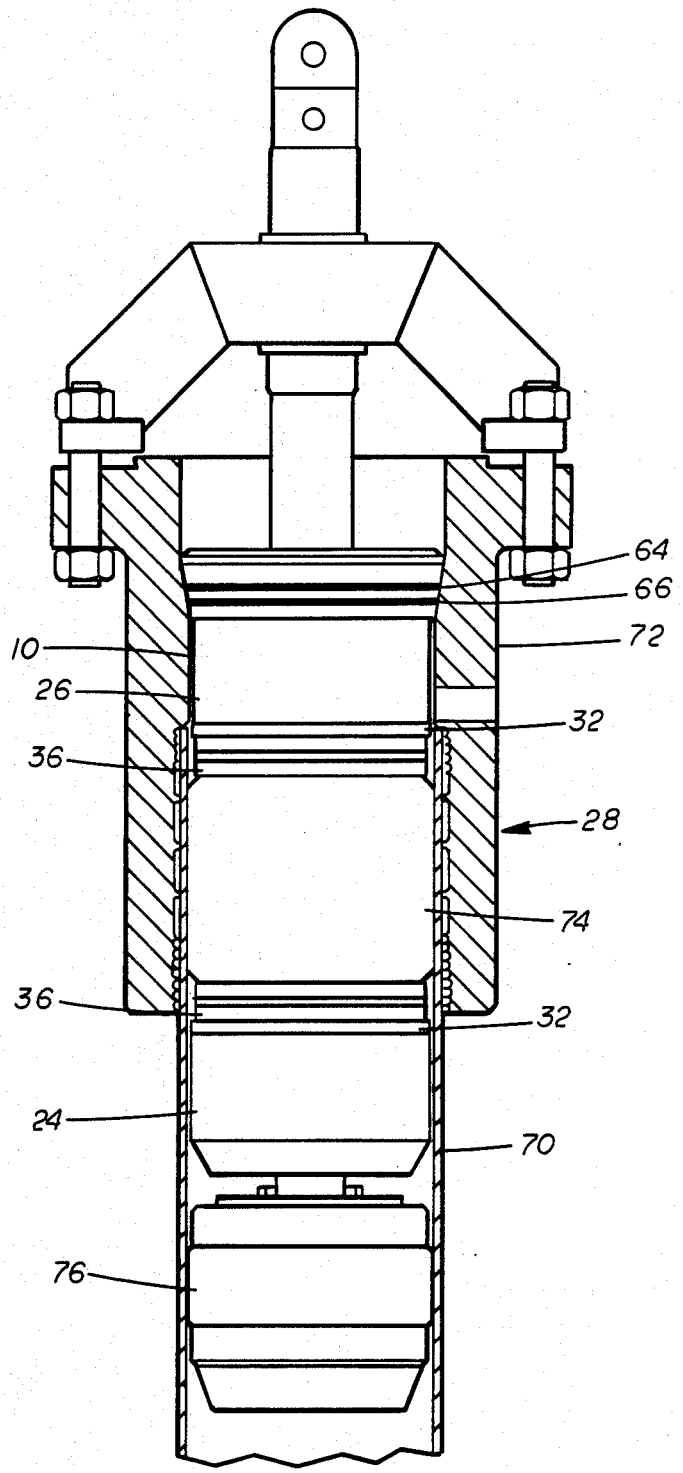
FIG. 4 is a similar partial detail sectional view to FIG. 2 but showing the sleeve subjected to internal forming pressure.

Improved forming tool 10 is shown in FIG. 4 positioned within the upper end of a tubular member 70 which is to be forged radially outward by tool 10 into tight gripping and sealing engagement with the interior of annular housing 72 which has a suitable grooved interior surface 74. Packoff tool 76 or other suitable sealing structure, such as a cup packer, is supported within tubular member 70 below forming tool 10 and is used to seal against the interior of tubular member 70 after its forming has been completed so that test pressure supplied through fitting 52 and passage 60 is contained and such testing pressure is exerted on the formed joint between tubular member 70 and annular housing 72. Any reduction of pressure on this test pressure line after testing pressure has been released is indicative that the formed joint is not completely pressure tight. The reason for the use of the lower packing tool 76 is to ensure that pressure in forming tool 10 during testing does not deform tubular member 70 at the initiation of testing sufficient to provide a seal engagement which has not been accomplished by the forming of the tubular member 70 by the forming tool 10.

What is claimed is:

1. A forming tool comprising a mandrel having means establishing an external upper downwardly facing shoulder and an external lower upwardly facing shoulder with a generally cylindrical surface between such shoulders, a forming assemble positioned between said shoulders and including upper and lower end rings each having an inner lip extending in the direction toward the opposite end ring and being in engagement with the exterior cylindrical surface of said mandrel and an overhang providing a reentrant recess radially outward from the point of engagement of said lips with the remainder of said end rings, a resilient sleeve having its ends bonded within said re-entrant recesses in said end rings and surrounding said external cylindrical mandrel surface, and means for delivering a forming pressure to the inner surface of said resilient sleeve whereby it is moved radially outward with sufficient force for cold forming a tubular member radially outward.

2. A forming tool according to claim 1 including anti-extrusion means surrounding the upper and lower ends of said sleeve adjacent said end rings.

3. A forming tool according to claim 1 including a pair of sealing grooves in the mandrel exterior cylindrical surface at positions within said end ring lips, and a seal within each of said sealing grooves for sealing between the exterior of said mandrel and the interior of said end ring lips.

4. A forming tool according to claim 3 wherein each of said seals is a pressure responsive sealing assembly.

5. A forming tool according to claim 4 wherein said seals each include a seal body, an inner and an outer lip at one end of said body, and means for urging said lips apart into sealing engagement between the groove and the end ring lip.

6. A forming tool according to claim 2 wherein said anti-extrusion means includes a plurality of segments surrounding each end of said sleeve and forming a ring, and means for urging said segments radially inward to maintain said ring while said sleeve is exposed to internal pressure, said ring of segments presenting minimum clearance between their exterior surface and the member being formed to limit extrusion of the sleeve.

7. A forming tool according to claim 1 wherein said pressure is supplied through a passage extending through said mandrel.

8. A forming tool according to claim 1 including sealing means supported from said mandrel and positioned below the mandrel for sealing the interior of a tubular member after it has been formed outward for testing of the seal of the joint made by such deformation of the tubular member.

9. A forming tool according to claim 1 wherein said sealing means includes a packoff tool secured to the lower end of said mandrel, said packoff tool being sized to provide a sealing engagement with the interior of the member being formed at a position below the mandrel.

* * * * *